US010556244B2

(12) United States Patent
Benitez

(10) Patent No.: US 10,556,244 B2
(45) Date of Patent: Feb. 11, 2020

(54) DISPENSING SHOWER HEAD ASSEMBLY

(71) Applicant: David Benitez, Ventura, CA (US)

(72) Inventor: David Benitez, Ventura, CA (US)

( * ) Notice: Subject to any disclaimer, the term of this patent is extended or adjusted under 35 U.S.C. 154(b) by 233 days.

(21) Appl. No.: 15/688,967

(22) Filed: Aug. 29, 2017

(65) Prior Publication Data

US 2019/0060926 A1 Feb. 28, 2019

(51) Int. Cl.

| | |
|---|---|
| ***B05B 7/04*** | (2006.01) |
| ***B05B 7/24*** | (2006.01) |
| ***E03C 1/046*** | (2006.01) |
| ***B05B 15/65*** | (2018.01) |
| *B05B 1/18* | (2006.01) |

(52) U.S. Cl.

CPC ..... *B05B 7/0408* (2013.01); *B05B 7/2443* (2013.01); *B05B 7/2464* (2013.01); *B05B 15/65* (2018.02); *E03C 1/046* (2013.01); *B05B 1/18* (2013.01)

(58) Field of Classification Search

CPC ..... E03C 1/0408; E03C 1/0409; E03C 1/046; E03C 1/0465; B05B 1/18; B05B 7/2464

USPC ..... 239/310

See application file for complete search history.

(56) References Cited

U.S. PATENT DOCUMENTS 3,446,438 A * 5/1969 Watson ..... E03C 1/046 100/229 R
3,917,172 A 11/1975 O'Hare
4,218,013 A * 8/1980 Davison ..... B05B 7/12 137/889
5,135,173 A 8/1992 Cho
5,174,503 A * 12/1992 Gasaway ..... B05B 7/30 222/132
6,036,110 A * 3/2000 Kanatzar ..... E03C 1/046 239/317
6,041,971 A 3/2000 Pineda
6,550,695 B1 4/2003 Trent
D543,608 S 5/2007 O'Brien et al.
8,490,890 B2 * 7/2013 Craig ..... B01F 5/0496 239/310
9,157,218 B2 10/2015 Somerfield et al.
9,359,748 B1 * 6/2016 Lamy ..... E03C 1/046
2006/0011746 A1 1/2006 De Simone
2009/0045268 A1 2/2009 Selander et al.
2012/0213279 A1 8/2012 Lu et al.

* cited by examiner

*Primary Examiner* — Alexander M Valvis
*Assistant Examiner* — Qingzhang Zhou

(57) ABSTRACT

A dispensing shower head assembly for selectively dispensing fluids through the shower head includes a housing that is configured to couple to a shower enclosure. A pipe, which is fluidically coupled to a water line, is coupled to and extends from the housing. A spray head is fluidically coupled to the pipe distal from the housing. The spray head has a lower face that is perforated. A plurality of reservoirs and a dispensing module are coupled to and positioned in the housing. The dispensing module is fluidically coupled to the spray head and selectively fluidically couplable to the reservoirs. Each reservoir is configured to fill with a respective fluid, such as a facewash, a conditioner, a body wash, and a shampoo. The dispensing module is positioned to motivate the respective fluid from an associated reservoir to the spray head to apply the respective fluid to a user.

13 Claims, 5 Drawing Sheets

DISPENSING SHOWER HEAD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shower head assemblies and more particularly pertains to a new shower head assembly for selectively dispensing fluids through the shower head.

BRIEF SUMMARY OF THE INVENTION

An embodiment of the disclosure meets the needs presented above by generally comprising a housing that is configured to couple to a shower enclosure. A pipe, which is fluidically coupled to a water line, is coupled to and extends from the housing. A spray head is fluidically coupled to the pipe distal from the housing. The spray head has a lower face that is perforated. A plurality of reservoirs and a dispensing module are coupled to and positioned in the housing. The dispensing module is fluidically coupled to the spray head and selectively fluidically couplable to the reservoirs. Each reservoir is configured to fill with a respective fluid, such as a facewash, a conditioner, a body wash, and a shampoo. The dispensing module is positioned to motivate the respective fluid from an associated reservoir to the spray head to apply the respective fluid to a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
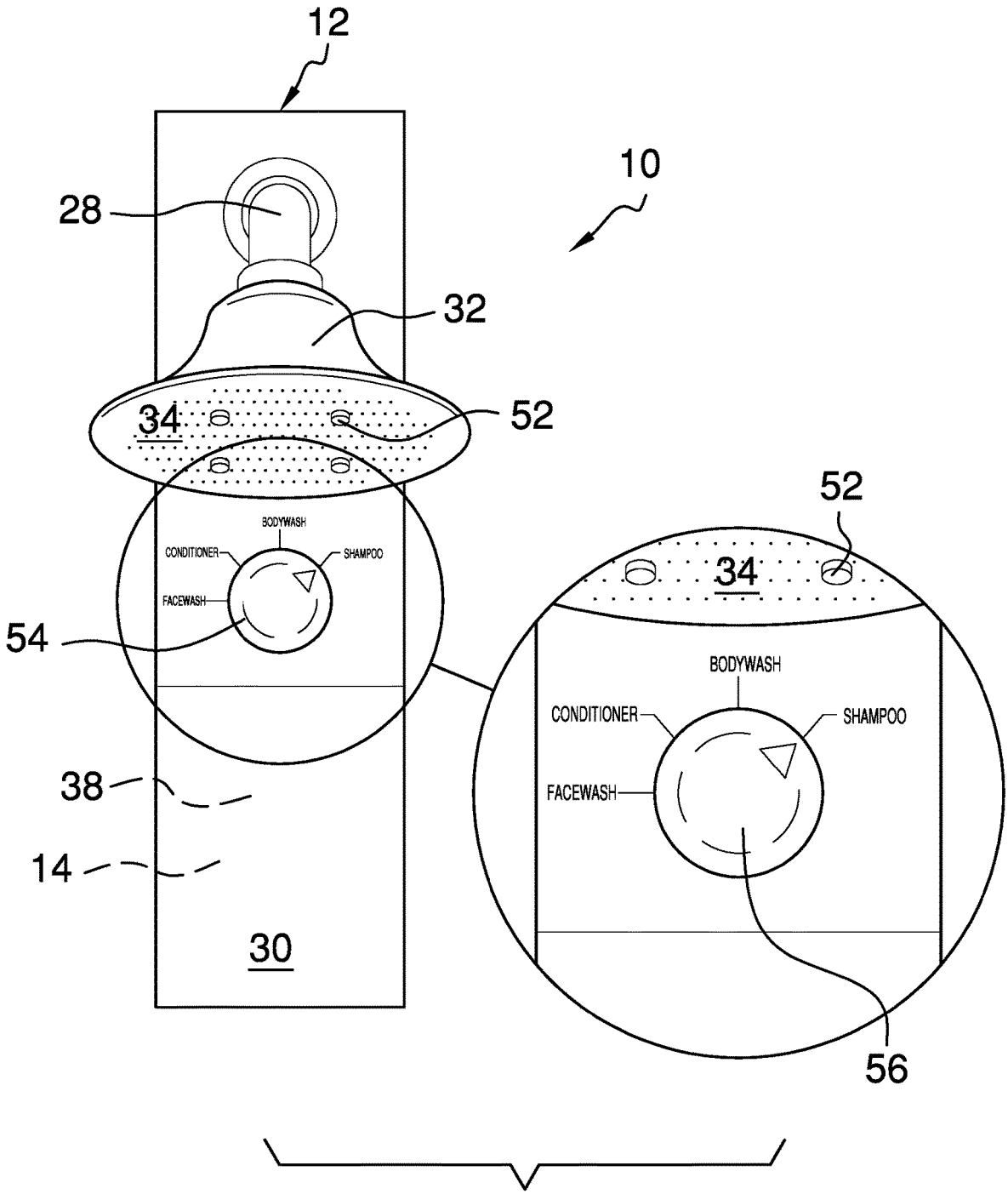
FIG. 1 is a front view of a dispensing shower head assembly according to an embodiment of the disclosure.
Figure 2:
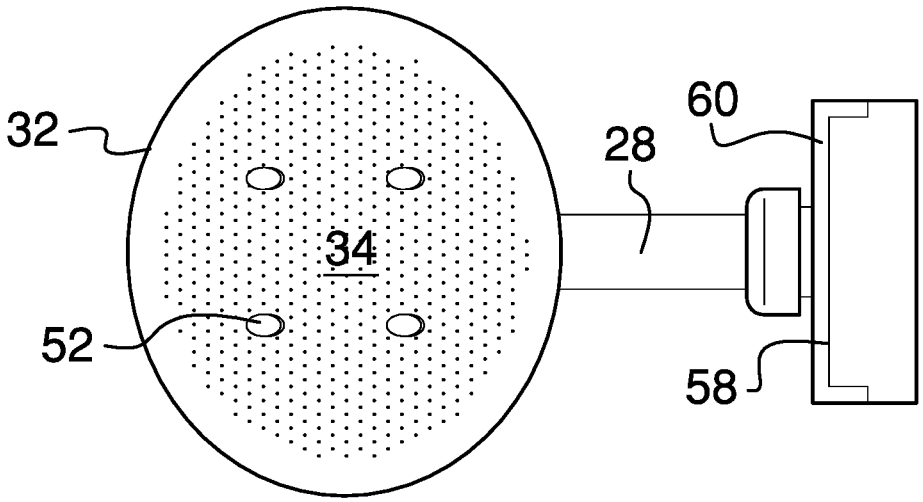
FIG. 2 is a bottom view of an embodiment of the disclosure.
Figure 3:
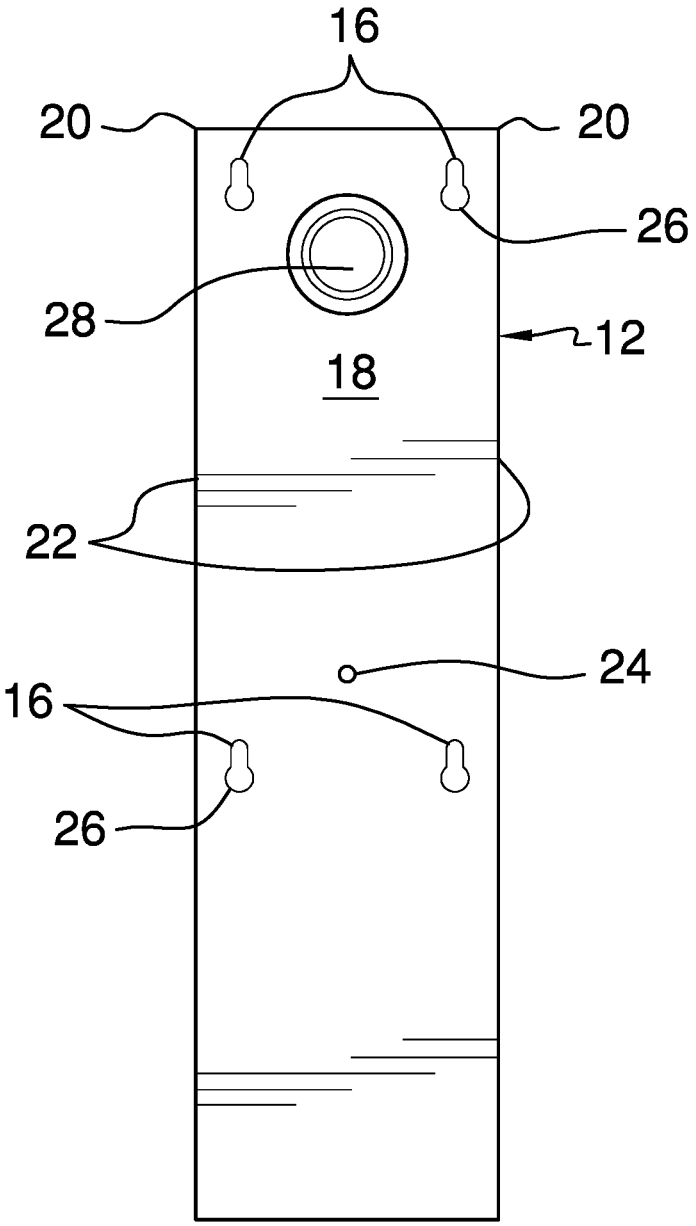
FIG. 3 is a back view of an embodiment of the disclosure.
Figure 4:
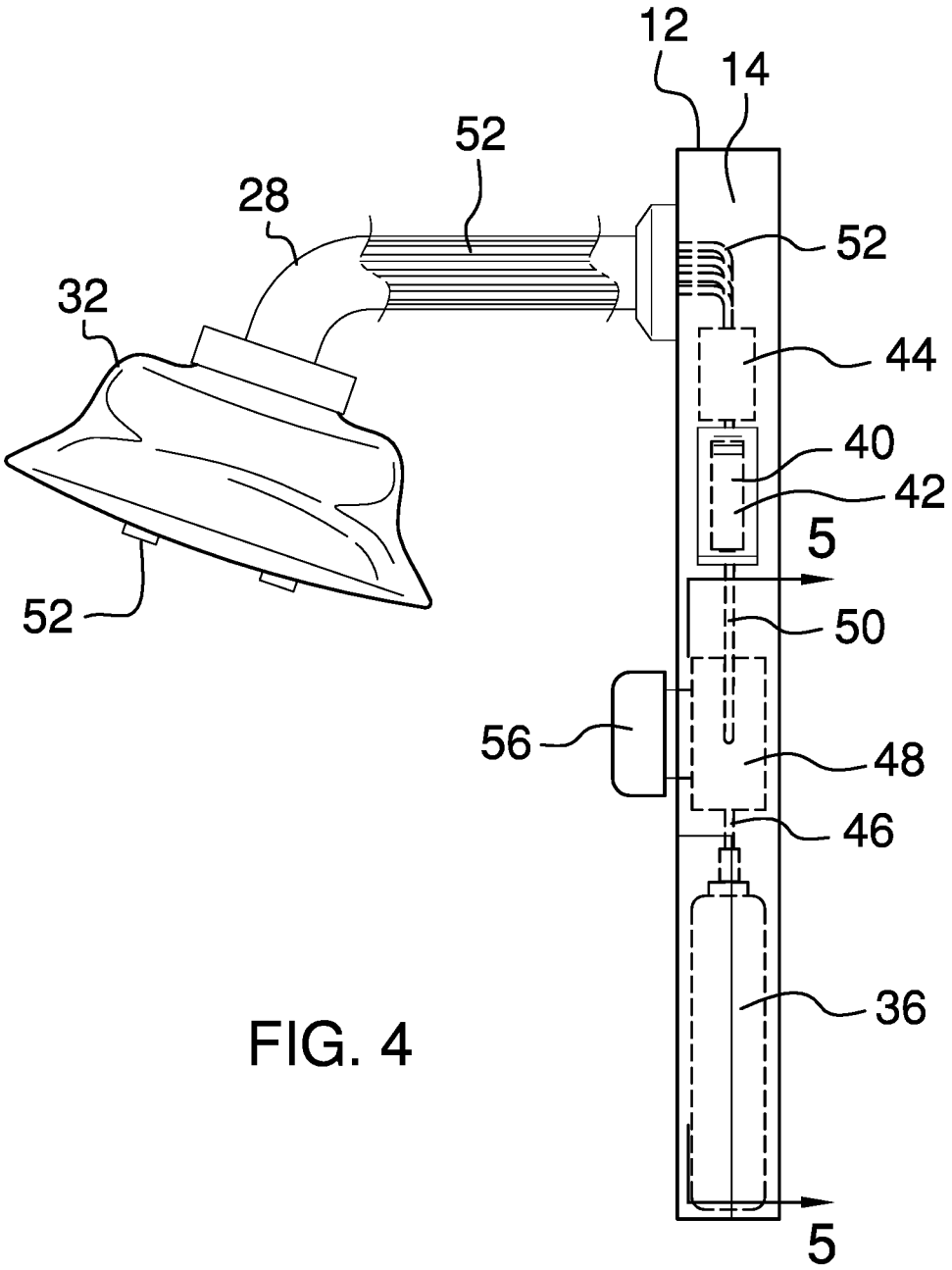
FIG. 4 is a cross-sectional view of an embodiment of the disclosure.
Figure 5:
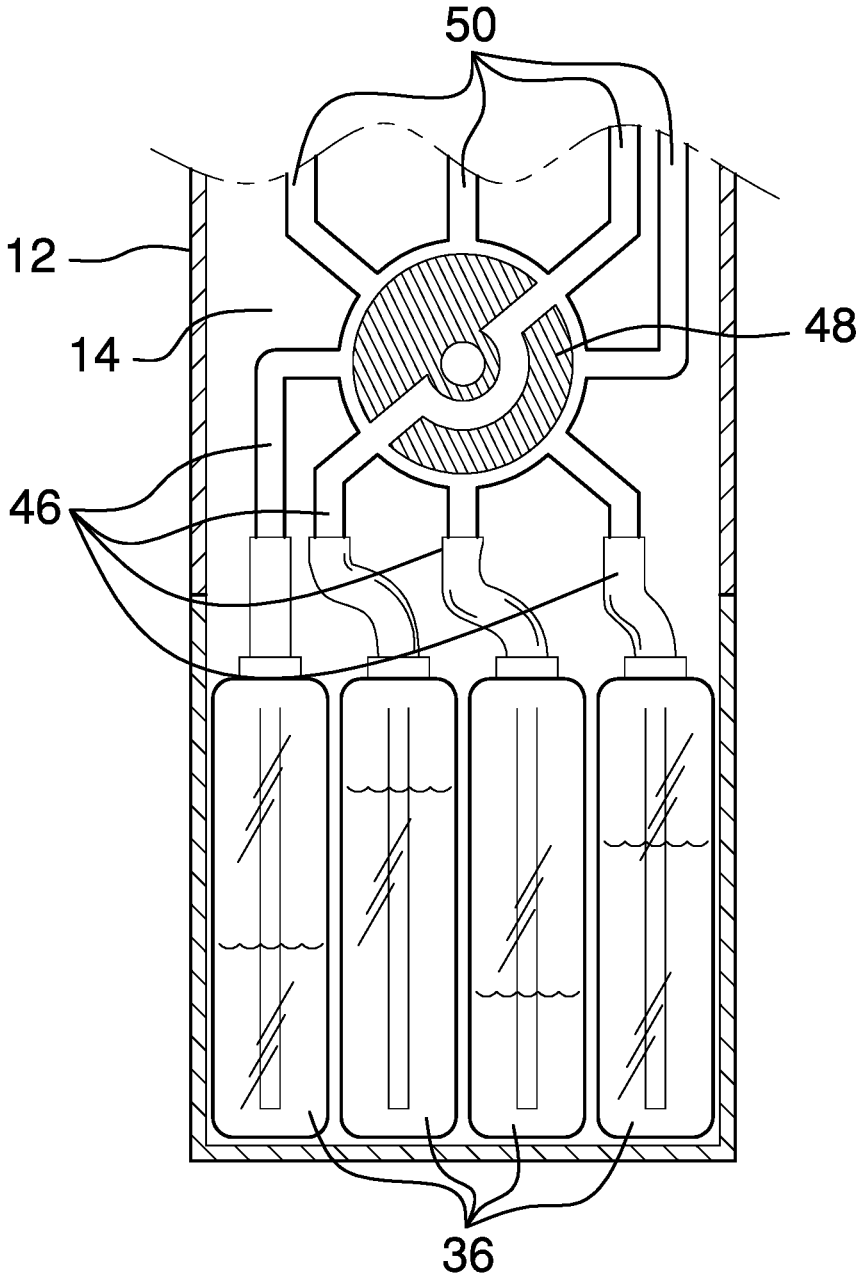
FIG. 5 is a cross-sectional view of an embodiment of the disclosure.

With reference now to the drawings, and in particular to FIGS. 1 through 5 thereof, a new shower head assembly embodying the principles and concepts of an embodiment of the disclosure and generally designated by the reference numeral 10 will be described.

As best illustrated in FIGS. 1 through 5, the dispensing shower head assembly 10 generally comprises a housing 12 that defines an interior space 14. The housing 12 is configured to couple to a shower enclosure. In one embodiment, the housing 12 is substantially rectangularly box shaped.

A plurality of couplers 16 is coupled to a back 18 of the housing 12. The couplers 16 are configured to couple to the shower enclosure to couple the housing 12 to the shower enclosure. In one embodiment, the plurality of couplers 16 comprises two couplers 16 that are positioned singly proximate to upper corners 20 of the housing 12. In another embodiment, the plurality of couplers 16 comprises two couplers 16 that are positioned singly proximate to opposing edges 22 and a midpoint 24 of the housing 12. In yet another embodiment, each coupler comprises a penetration 26 that is positioned through the back 18. Each penetration 26 is configured to insert a respective article of mounting hardware to couple the housing 12 to the shower enclosure.

A pipe 28 is coupled to and extends from a front 30 of the housing 12. The pipe 28 is fluidically coupled to a water line. A spray head 32 is fluidically coupled to the pipe 28 distal from the housing 12. The spray head 32 has a lower face 34 that is perforated. The lower face 34 is configured to release water from the spray head 32.

A plurality of reservoirs 36 is coupled to the housing 12 and is positioned in the interior space 14. Each reservoir 36 is configured to fill with a respective fluid, such as a facewash, a conditioner, a body wash, and a shampoo. In one embodiment, the plurality of reservoirs 36 comprises four reservoirs 36.

A dispensing module 38 is coupled to the housing 12 and is positioned in the interior space 14. The dispensing module 38 is fluidically coupled to the spray head 32 and selectively fluidically couplable to the reservoirs 36. The dispensing module 38 is positioned to motivate the respective fluid from an associated reservoir 36 to the spray head 32. The spray head 32 is configured to apply the respective fluid to a user.

The dispensing module 38 comprises a power module 40. In one embodiment, the power module 40 comprises at least one battery 42. A pump 44 is operationally coupled to the power module 40. Each of a plurality of first tubes 46 is fluidically coupled to a respective reservoir 36. A valve 48 is rotationally coupled to the housing 12. The valve 48 is coupled to the plurality of first tubes 46 distal from the reservoirs 36. The valve 48 also is selectively fluidically couplable to the first tubes 46.

A plurality of second tubes 50 is fluidically coupled to the pump 44 and selectively fluidically couplable the valve 48. The valve 48 is positioned to selectively fluidically couple a respective first tube 46 to an associated second tube 50 to selectively couple the associated reservoir 36 to the pump 44.

At least one third tube 52 is fluidically coupled to and extends between the pump 44 and the spray head 32. The pump 44 is positioned to motivate the respective fluid from the associated reservoir 36 through the respective first tube 46, the associated second tube 50, and the at least on third tube 52 to the spray head 32. The spray head 32 is configured to apply the respective fluid to the user. In another embodiment, the at least one third tube 52 protrudes from the lower face 34 of the spray head 32.

A controller 54 is coupled to the front 30 of the housing 12. The controller 54 is operationally coupled to the dispensing module 38. The controller 54 is positioned to compel the dispensing module 38 to selectively fluidically couple to the associated reservoir 36. The dispensing module 38 is positioned to motivate the respective fluid from the associated reservoir 36 to the spray head 32. The spray head 32 is configured to apply the respective fluid to the user.

In one embodiment, the controller 54 comprises a knob 56 that is coupled to the valve 48. The valve 48 is positioned to be rotated coincident with the knob 56. The knob 56 is configured to be grasped in a hand of the user to rotate the valve 48 to compel the valve 48 to selectively fluidically couple the respective first tube 46 to the associated second tube 50. The associated reservoir 36 is selectively coupled to the pump 44. The pump 44 is positioned to motivate the respective fluid from the associated reservoir 36 through the respective first tube 46, the associated second tube 50, and the at least on third tube 52 to the spray head 32. The spray head 32 is configured to apply the respective fluid to the user.

A cutout 58 is positioned in the front 30 the housing 12 adjacent to the reservoirs 36 and the power module 40. The cutout 58 is configured to access the interior space 14 to service the reservoirs 36 and the power module 40. A panel 60 that is complementary to the cutout 58 is selectively slidably couplable to the housing 12 to open and to close the cutout 58.

In use, the penetrations 26 are positioned in the back 18 so that each penetration 26 is configured to insert the respective article of mounting hardware to couple the housing 12 to the shower enclosure. Each reservoir 36 is configured to fill with the respective fluid, such as the facewash, the conditioner, the body wash, and the shampoo. The knob 56 that is positioned on the housing 12 is configured to be grasped in the hand of the user to rotate the valve 48 to compel the valve 48 to selectively fluidically couple the respective first tube 46 to the associated second tube 50. The associated reservoir 36 is selectively coupled to the pump 44. The pump 44 is positioned to motivate the respective fluid from the associated reservoir 36 through the respective first tube 46, the associated second tube 50, and the at least on third tube 52 to the spray head 32. The spray head 32 is configured to apply the respective fluid to the user. The cutout 58 that is positioned in the housing 12 is configured to access the interior space 14 to service the reservoirs 36 and the power module 40. The panel 60 is selectively slidably couplable to the housing 12 to open and to close the cutout 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dispensing shower head assembly comprising:

a housing defining an interior space, said housing being configured for coupling to a shower enclosure;

a pipe coupled to and extending from a front of said housing, said pipe being fluidically coupled to a water line;

a spray head fluidically coupled to said pipe distal from said housing, said spray head having a lower face, said lower face being perforated such that said lower face is configured for releasing water from said spray head;

a plurality of reservoirs coupled to said housing and positioned in said interior space;

a dispensing module coupled to said housing and positioned in said interior space, said dispensing module being fluidically coupled to said spray head and selectively fluidically couplable to said reservoirs;

wherein said reservoirs are positioned in said housing such that each said reservoir is configured for filling with a respective fluid wherein said dispensing module is positioned in said housing such that said dispensing module is positioned for motivating the respective fluid from an associated reservoir of said plurality of reservoirs to said spray head such that said spray head is configured for applying the respective fluid to a user; and said dispensing module comprising a power module, a pump operationally coupled to said power module, a plurality of first tubes, each said first tube being fluidically coupled to a respective said reservoir, a valve rotationally coupled to said housing, said valve being coupled to said plurality of first tubes distal from said reservoirs, said valve being selectively fluidically couplable to said plurality of first tubes, a plurality of second tubes fluidically coupled to said pump and selectively fluidically couplable said valve, at least one third tube, said at least one third tube being fluidically coupled to and extending between said pump and said spray head, and wherein said valve is positioned on said first tubes and said plurality of second tubes such that said valve is positioned for selectively fluidically coupling a respective first tube of said plurality of first tubes to an associated second tube of said plurality of second tubes for selectively coupling said associated reservoir of said plurality of reservoirs to said pump, wherein said at least one third tube is positioned on said pump such that said pump is positioned for motivating the respective fluid from said associated said reservoir through said respective said first tube, said associated said second tube, and said at least on third tube to said spray head such that said spray head is configured for applying the respective fluid to the user.

2. The assembly of claim 1, further including said housing being substantially rectangularly box shaped.

3. The assembly of claim 1, further including a plurality of couplers coupled to a back of said housing, said plurality of couplers being configured for coupling to the shower enclosure for coupling said housing to the shower enclosure.

4. The assembly of claim 3, further including said plurality of couplers comprising two couplers positioned singly proximate to upper corners of said housing.

5. The assembly of claim 4, further including said plurality of couplers comprising another two couplers positioned singly proximate to opposing edges and a midpoint of said housing.

6. The assembly of claim 3, further including each coupler of said plurality of couplers comprising a penetration positioned through said back, wherein said penetrations are positioned in said back such that each of said penetrations is configured for inserting a respective article of mounting hardware for coupling said housing to the shower enclosure.

7. The assembly of claim 1, further including said plurality of reservoirs comprising four reservoirs.

8. The assembly of claim 1, further including said power module comprising at least one battery.

9. The assembly of claim 1, further including said at least one third tube protruding from said lower face of said spray head.

10. The assembly of claim 1, further including a controller coupled to said front of said housing, said controller being operationally coupled to said dispensing module, wherein said controller is positioned on said housing such that said controller is positioned for compelling said dispensing module for selectively fluidically coupling to said associated reservoir of said plurality of reservoirs such that said dispensing module is positioned for motivating the respective fluid from said associated said reservoir to said spray head such that said spray head is configured for applying the respective fluid to the user.

11. The assembly of claim 10, further including said controller comprising a knob coupled to said valve such that said valve is positioned for rotating coincident with said knob, wherein said knob is positioned on said housing such that said knob is configured for grasping in a hand of the user for rotating said valve for compelling said valve for selectively fluidically coupling said respective said first tube to said associated said second tube for selectively coupling said associated said reservoir to said pump such that said pump is positioned for motivating the respective fluid from said associated said reservoir through said respective said first tube, said associated said second tube, and said at least on third tube to said spray head such that said spray head is configured for applying the respective fluid to the user.

12. The assembly of claim 1, further comprising:

a cutout positioned in said front of said housing adjacent to said reservoirs and said power module;

a panel complementary to said cutout, said panel being selectively slidably couplable to said housing for opening and for closing said cutout; and wherein said cutout is positioned in said housing such that said cutout is configured for accessing said interior space for servicing said reservoirs and said power module.

13. A dispensing shower head assembly comprising:

a housing defining an interior space, said housing being configured for coupling to a shower enclosure, said housing being substantially rectangularly box shaped;

a plurality of couplers coupled to a back of said housing, said plurality of couplers being configured for coupling to the shower enclosure for coupling said housing to the shower enclosure, said plurality of couplers comprising two said couplers positioned singly proximate to upper corners of said housing, said plurality of couplers comprising another two couplers positioned singly proximate to opposing edges and a midpoint of said housing, each said coupler comprising a penetration positioned through said back, wherein said penetrations are positioned in said back such that each of said penetrations is configured for inserting a respective article of mounting hardware for coupling said housing to the shower enclosure;

a pipe coupled to and extending from a front of said housing, said pipe being fluidically coupled to a water line;

a spray head fluidically coupled to said pipe distal from said housing, said spray head having a lower face, said lower face being perforated such that said lower face is configured for releasing water from said spray head;

a plurality of reservoirs coupled to said housing and positioned in said interior space, wherein said reservoirs are positioned in said housing such that each said reservoir is configured for filling with a respective fluid, said plurality of reservoirs comprising four reservoirs;

a dispensing module coupled to said housing and positioned in said interior space, said dispensing module being fluidically coupled to said spray head and selectively fluidically couplable to said reservoirs, wherein said dispensing module is positioned in said housing such that said dispensing module is positioned for motivating the respective fluid from an associated reservoir of said plurality of reservoirs to said spray head such that said spray head is configured for applying the respective fluid to a user, said dispensing module comprising:

a power module, said power module comprising at least one battery, a pump operationally coupled to said power module, a plurality of first tubes, each said first tube being fluidically coupled to a respective said reservoir, a valve rotationally coupled to said housing, said valve being coupled to said plurality of first tubes distal from said reservoirs, said valve being selectively fluidically couplable to said plurality of first tubes, a plurality of second tubes fluidically coupled to said pump and selectively fluidically couplable said valve, wherein said valve is positioned on said first tubes and said plurality of second tubes such that said valve is positioned for selectively fluidically coupling a respective first tube of said plurality of first tubes to an associated second tube of said plurality of second tubes for selectively coupling said associated reservoir of said plurality of reservoirs to said pump, and at least one third tube, said at least one third tube being fluidically coupled to and extending between said pump and said spray head, wherein said at least one third tube is positioned on said pump such that said pump is positioned for motivating the respective fluid from said associated reservoir of said plurality of reservoirs through said respective said first tube, said associated said second tube, and said at least on third tube to said spray head such that said spray head is configured for applying the respective fluid to the user, said at least one third tube protruding from said lower face of said spray head;

a controller coupled to said front of said housing, said controller being operationally coupled to said dispensing module, wherein said controller is positioned on said housing such that said controller is positioned for compelling said dispensing module for selectively fluidically coupling to said associated reservoir of said plurality of reservoirs such that said dispensing module is positioned for motivating the respective fluid from said associated reservoir of said plurality of reservoirs to said spray head such that said spray head is configured for applying the respective fluid to the user, said controller comprising a knob coupled to said valve such that said valve is positioned for rotating coincident with said knob, wherein said knob is positioned on said housing such that said knob is configured for grasping in a hand of the user for rotating said valve for compelling said valve for selectively fluidically coupling said respective said first tube to said associated said second tube for selectively coupling said associated reservoir of said plurality of reservoirs to said pump such that said pump is positioned for motivating the respective fluid from said associated reservoir of said plurality of reservoirs through said respective said first tube, said associated said second tube, and said at least on third tube to said spray head such that said spray head is configured for applying the respective fluid to the user;

a cutout positioned in said front of said housing adjacent to said plurality of reservoirs and said power module, wherein said cutout is positioned in said housing such that said cutout is configured for accessing said interior space for servicing said plurality of reservoirs and said power module;

a panel complementary to said cutout, said panel being selectively slidably couplable to said housing for opening and for closing said cutout.

* * * * *